US007255052B2

(12) United States Patent
Okazaki

(10) Patent No.: US 7,255,052 B2
(45) Date of Patent: Aug. 14, 2007

(54) EMBROIDERY FRAME

(75) Inventor: Yoshiyuki Okazaki, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 81 days.

(21) Appl. No.: 11/341,499

(22) Filed: Jan. 30, 2006

(65) Prior Publication Data

US 2006/0180066 A1 Aug. 17, 2006

(30) Foreign Application Priority Data

Jan. 28, 2005 (JP) ..... 2005-021363

(51) Int. Cl.
*D05C 9/04* (2006.01)
*D05C 3/02* (2006.01)

(52) U.S. Cl. ..... 112/103

(58) Field of Classification Search ..... 112/103, 112/470.14, 117, 475.11, 475.18, 102.91, 112/102; 160/371, 378, 380
See application file for complete search history.

(56) References Cited

U.S. PATENT DOCUMENTS 3,664,288 A * 5/1972 Von Doden et al. ..... 112/103
4,485,574 A * 12/1984 Bennetot ..... 38/102.2
4,587,910 A * 5/1986 Raines ..... 112/148
4,762,076 A * 8/1988 Wakaizumi ..... 112/103
4,981,092 A * 1/1991 Bauman et al. ..... 112/103
5,144,899 A * 9/1992 Allen ..... 112/103
6,109,194 A * 8/2000 Farb ..... 112/103
6,640,735 B2 * 11/2003 Kwang ..... 112/475.18

FOREIGN PATENT DOCUMENTS

| | | |
|---|---|---|
| JP | A-57-81369 | 5/1982 |
| JP | Y2-63-27674 | 7/1988 |
| JP | U-03-111589 | 11/1991 |
| JP | Y2-07-54315 | 12/1995 |
| JP | A 8-243280 | 9/1996 |

* cited by examiner

*Primary Examiner*—Ismael Izaguirre
(74) *Attorney, Agent, or Firm*—Oliff & Berridge, PLC

(57) ABSTRACT

An embroidery frame provided with an upper frame, a lower frame that clamps a workpiece cloth with the upper frame, a hinge openably linking the upper and lower frames, a clamping unit that presses the upper frame to the lower frame, an auxiliary frame which is fitted in an inner side of the upper frame and which downwardly presses the workpiece cloth clamped between the upper and lower frames, and a regulating mechanism which is fitted in the upper frame and which regulates the upward movement of the auxiliary frame with respect to the upper frame.

11 Claims, 10 Drawing Sheets

EMBROIDERY FRAME

CROSS-REFERENCE TO RELATED APPLICATIONS

This application is based upon and claims the benefit of priority from the prior Japanese Patent Application No. JP-2005-021363, filed on Jan. 28, 2005 the entire contents of which are incorporated herein by reference.

TECHNICAL FIELD

The disclosure relates to an embroidery frame that clamps a workpiece cloth with an upper frame and a lower frame.

BACKGROUND

Conventionally, an embroidery frame has been used that retains an embroidery workpiece cloth in a stretched manner. The embroidery frame clamps the workpiece cloth between an inner peripheral surface of an outer frame and an outer peripheral surface of an inner frame. Therefore, the problem with such embroidery frame is that creases are formed when the workpiece cloth is removed from between the outer and inner frames. Also, the outer frame is equipped with a clamping screw for adjusting the size of the outer frame. Therefore, whenever the workpiece cloth is attached to or detached from the embroidery frame, the clamping screw needs to be operated in order to adjust the size of the outer frame. This impairs workability of the sewing process.

On the other hand, embroidery frames that retain the workpiece cloth between upper and lower frames have been suggested. In such embroidery frames, the workpiece cloth is less prone to creasing, since the workpiece cloth is clamped between the lower surface of the upper frame and the upper surface of the lower frame. However, since the embroidery frame is constructed to simply press the upper frame against the lower frame, sufficient tension cannot be applied to the workpiece cloth clamped between the upper and lower frames. Also, cloth retainability is inferior to embroidery frames constructed by the outer frame and the inner frame. Thus, during the sewing process, the workpiece cloth is gradually pulled inwardly by the thread tension of embroidery patterns, leading to pattern distortion and impairment of sewing quality.

Such being the case, embroidery frames equipped with an auxiliary frame that further downwardly press the workpiece cloth clamped between the upper and lower frames have been reduced to practice. For example, JP-A-8-243280 discloses a sewing cloth-retaining frame of a clamp type provided with a base frame (lower frame), a first presser frame (upper frame), a second presser frame (auxiliary frame), a first clamp mechanism that presses the upper frame against the lower frame, and a second clamp mechanism that presses the auxiliary frame against the lower frame. The lower frame is provided with a first receiving portion, an elevated portion formed as an elevated stage in the inner peripheral portion of the first receiving portion, and a second receiving portion formed as a lowered stage in the inner peripheral portion of the elevated portion. After fixing the workpiece cloth to the lower frame by pressing the upper frame against the first receiving portion of the lower frame by the first clamp mechanism, when the auxiliary frame is pressed against the second receiving portion of the lower frame by the second clamp mechanism, the auxiliary frame downwardly presses the workpiece cloth in uneven levels in the inner peripheral portion of the upper frame. Thus, the workpiece cloth is retained in a sufficiently stretched state.

However, in the above constructed embroidery frame, in addition to the clamp mechanism that presses the upper frame against the lower frame, a clamp mechanism that presses the auxiliary frame to the workpiece cloth is required. This leads to an increase in the number of parts, consequently increasing the complexity as well as the weight of the embroidery frame.

SUMMARY

Therefore an object of the present disclosure is to provide an embroidery frame which is capable of securely retaining a workpiece cloth in a sufficiently stretched state between an upper frame and a lower frame and which has a simple and light-weight construction.

The embroidery frame according to the present disclosure is provided with the upper frame, the lower frame clamping the workpiece cloth cooperatively with the upper frame, a hinge that openably links the upper and lower frames, and a clamp unit that presses the upper frame against the lower frame. The embroidery frame in accordance with the present disclosure is further provided with an auxiliary frame which is fitted to an inner side of the upper frame and which downwardly presses the workpiece cloth clamped between the upper and lower frames, and a regulating mechanism that regulates the auxiliary frame, which is fitted to the upper frame, from moving upward with respect to the upper frame.

In the above construction, first, the workpiece cloth is clamped between the upper and lower frames, and the upper frame is pressed against the lower frame by the clamping unit. Then, when the auxiliary frame is fitted to the inner side of the upper frame, the upward movement of the auxiliary frame with respect to the upper frame is regulated by the regulating mechanism. Therefore, the auxiliary frame is able to securely press the workpiece cloth downward, thereby sufficiently stretching the workpiece cloth.

In this case, it is preferable to provide a flange in a portion of the upper end of the auxiliary frame as well as providing an engagement regulating member on the upper frame. The flange and the engagement regulating member engage with each other so as to regulate the upward movement of the auxiliary frame.

In a preferable construction, the engagement and the disengagement of the upper frame and the auxiliary frame can be switched by fitting the auxiliary frame to the upper frame and rotating the auxiliary frame in the circumferential direction by a predetermined angle with respect to the upper frame. It is also a preferable construction to provide an engagement mechanism capable of adjusting the pressure applied by the auxiliary frame to press the workpiece cloth.

In the above construction, the pressure applied by the auxiliary frame can be adjusted depending upon the thickness of the workpiece cloth.

It is further preferable to provide, on either one of the upper surface of the lower frame or the lower surface of the upper frame, a protrusion having a plurality of notched recesses in the outer peripheral portion thereof, and a groove having a projection on the outer periphery portion thereof on the other. The protrusion is fitted with the groove when the upper and lower frames are closed.

According to the above construction, the areas of the cloth clamping surfaces of the upper and lower frames are increased and the frictional force between the upper and lower frames and the workpiece cloth clamped therebetween is increased, thereby increasing the cloth retainability of the upper and lower frames.

Moreover, the length in the circumferential direction of the outer peripheral portion of the protrusion and the groove becomes longer than the circumferential direction of the inner peripheral portion owning to the notched recess and the projection. Therefore, since transformation of the workpiece cloth can be restrained by being clamped between the protrusion in the upper frame and the groove in the lower frame, workpiece cloth can be made less prone to creasing.

BRIEF DESCRIPTION OF THE DRAWINGS

Other objects, features and advantages of the present disclosure will become clear upon reviewing the following description of the illustrative aspects with reference to the accompanying drawings, in which.

DETAILED DESCRIPTION OF THE INVENTION

Several embodiments of the present invention will be described hereinafter with reference to the drawings.

Figure 1:
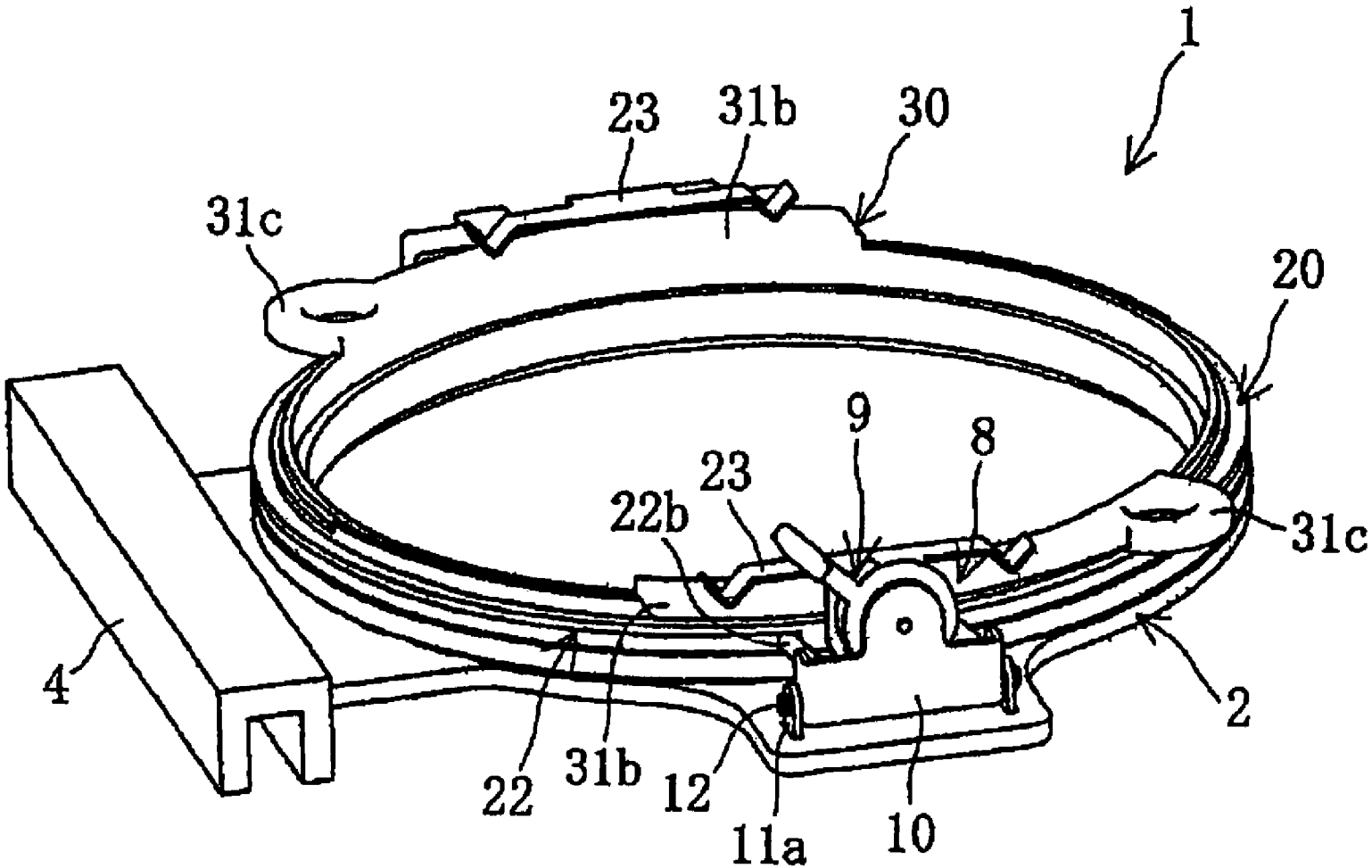
FIG. 1 is a perspective view of an embroidery frame showing a first illustrative aspect of the disclosure.

FIGS. 1 to 7 illustrate a first embodiment of the present invention. As shown in FIG. 1, an embroidery frame 1 is formed in a substantially annular form in flat view and is provided with a lower frame 2, an upper frame 20, and an auxiliary frame 30. The lower frame 2, the upper frame 20, and the auxiliary frame 30 are each made of synthetic resin material.

As shown in FIGS. 2 to 6, the lower frame 2 is provided with a protrusion 3*a*, a support base 3*b*, and a mounting portion 3*d*. The protrusion 3*a* with an angular section is formed on the entire periphery of the lower frame 2 upper surface. The mounting portion 3*d* in a substantially oblong-plate form is provided in an outwardly protruding manner on the front end of the lower frame 2. The support base 3*b* in a thick and substantially oblong form is provided in an outwardly protruding manner on the rear end of the lower frame 2.

Also, a carriage linkage 4, a hinge 5 that links the upper frame 20 openably to the lower frame 2, and a clamp mechanism 8 for retaining and pressing the upper frame 20 against the lower frame 2 are provided on the lower frame 2. The carriage linkage 4 is detachably linked to the carriage of the embroidery frame drive mechanism provided in an embroidery unit.

The hinge 5 is provided with a support base 3*b*, a pair of L-shaped hinge brackets 6, a hinge pin 22*a*, and a screw 7. A pair of bases 3*c* is provided in a protruding manner on the lateral ends of the upper surface of the support base 3*b*. The hinge brackets 6 are respectively fixed on the bases 3*c* by a couple of aforementioned screws 7. The hinge bracket 6 is provided with an upper plate 6*a* and a side plate 6*b* with a pin hole (not shown) formed thereto. The hinge pin 22*a* is passed through the pin hole.

The clamp mechanism B is provided with a cam member 9, a support body 10, a mounting plate 11, and a rotary shaft 12. A pair of upwardly protruding support pieces 11*a* is provided on the lateral ends of the mounting plate 11. The mounting plate 11 is inserted into the mounting portion 3*d* from below and is fixed to the mounting portion 3*d* by a screw 14. At this point, the pair of support pieces 11*a* project from the upper surface of the mounting portion 3*d*. A protruding portion 10*a* is formed on the left end of the support body 10. Also, the cam member 9 is rotatably linked to the support body 10 via the rotary shaft 13. The support body 10 is linked to the support pieces via a rotary shaft 12.

The cam member 9 is provided with a cam body 9*a* and an operating portion 9*b* integrally provided with the cam body 9*a*. The cam body 9*a* is provided with a cam main body 9*c* and flanges 9*d* and 9*e*. A cam surface (not shown) is formed on the cam main body 9*c*. The height of the lower end of the cam surface is arranged to be lowered (that is, the distance from the rotary shaft 13, which assumes the rotational center of the cam member 9, to the lower end of the cam surface is increased) in response to a counterclockwise rotation, as shown by arrow A in FIG. 2, of the operating portion 9*b*.

The flange 9*d* in the front side is formed in a disc form. On the other hand, the rear flange 9*e* is formed in a notched disc form so that a later described clamped portion 22*b* can be placed thereon when the upper frame 20 is closed.

Figure 7A:
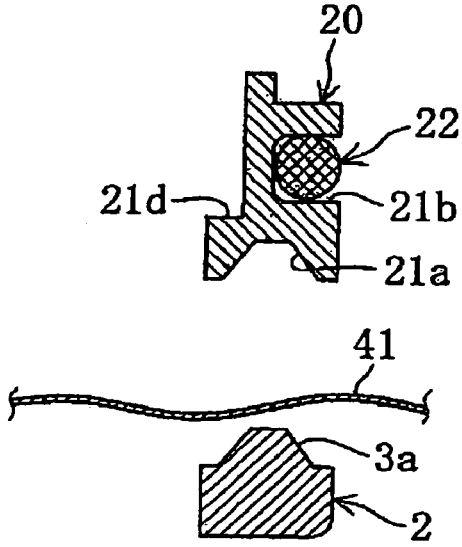
FIG. 7A shows a state before clamping a workpiece cloth between the upper and lower frames.
Figure 7B:
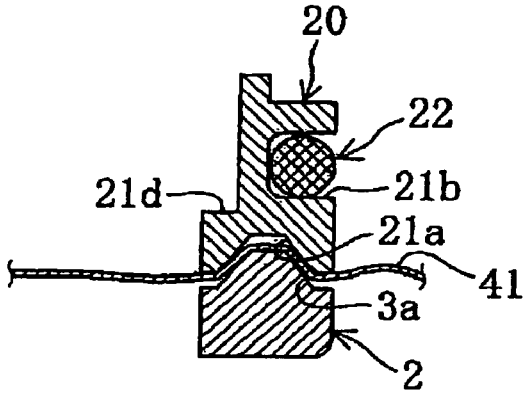
FIG. 7B shows a state wherein a workpiece cloth is clamped between the upper and lower frames.
Figure 7C:
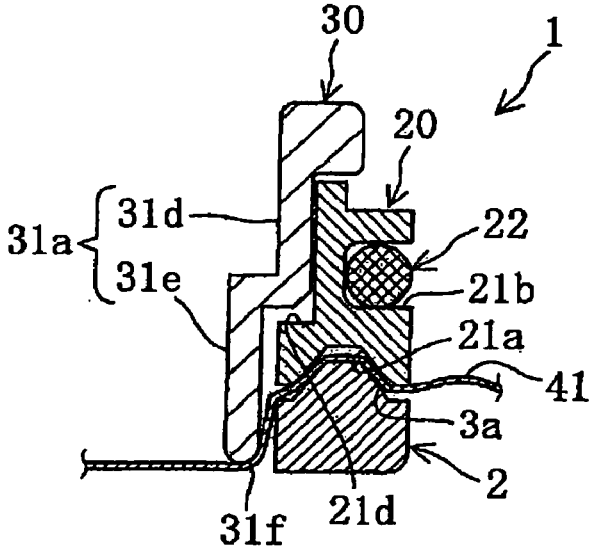
FIG. 7C shows a state wherein a workpiece cloth is clamped between the upper and lower frames and the auxiliary frame is engaged to the upper frame.

The upper frame 20 is provided with a groove 21*a* (refer to FIG. 2), a groove 21*b*, a longitudinally paired mounting portions 21*c*, and a staged portion 21*d* (refer to FIG. 7C). Also, the upper frame 20 is provided with the clamped portion 22*b* which is clamped by the clamp mechanism 8, a pair of engagement regulating members 23 that regulates the upward movement of the auxiliary frame 30, and a retaining member 22.

The groove 21*a* is formed on the entire periphery of the lower surface of the upper frame 20. The groove 21*a* engages to the protrusion 3*a* of the lower frame 2, and the workpiece cloth 41 is clamped by the groove 21*a* and the protrusion 3*a*.

The groove 21*b* is formed entirely on the outer periphery of the upper frame 20. The retaining member 22 made of metallic wire material in a substantially annular form is attached on the groove 21*b*. The hinge pins 22*a* are respectively formed integrally on the rear end portion (base end portion) of the retaining member 22. Also, a U-shaped clamped portion 22*b* is formed in a curvature on the front end (fore-end) of the retaining member 22.

Figure 3:
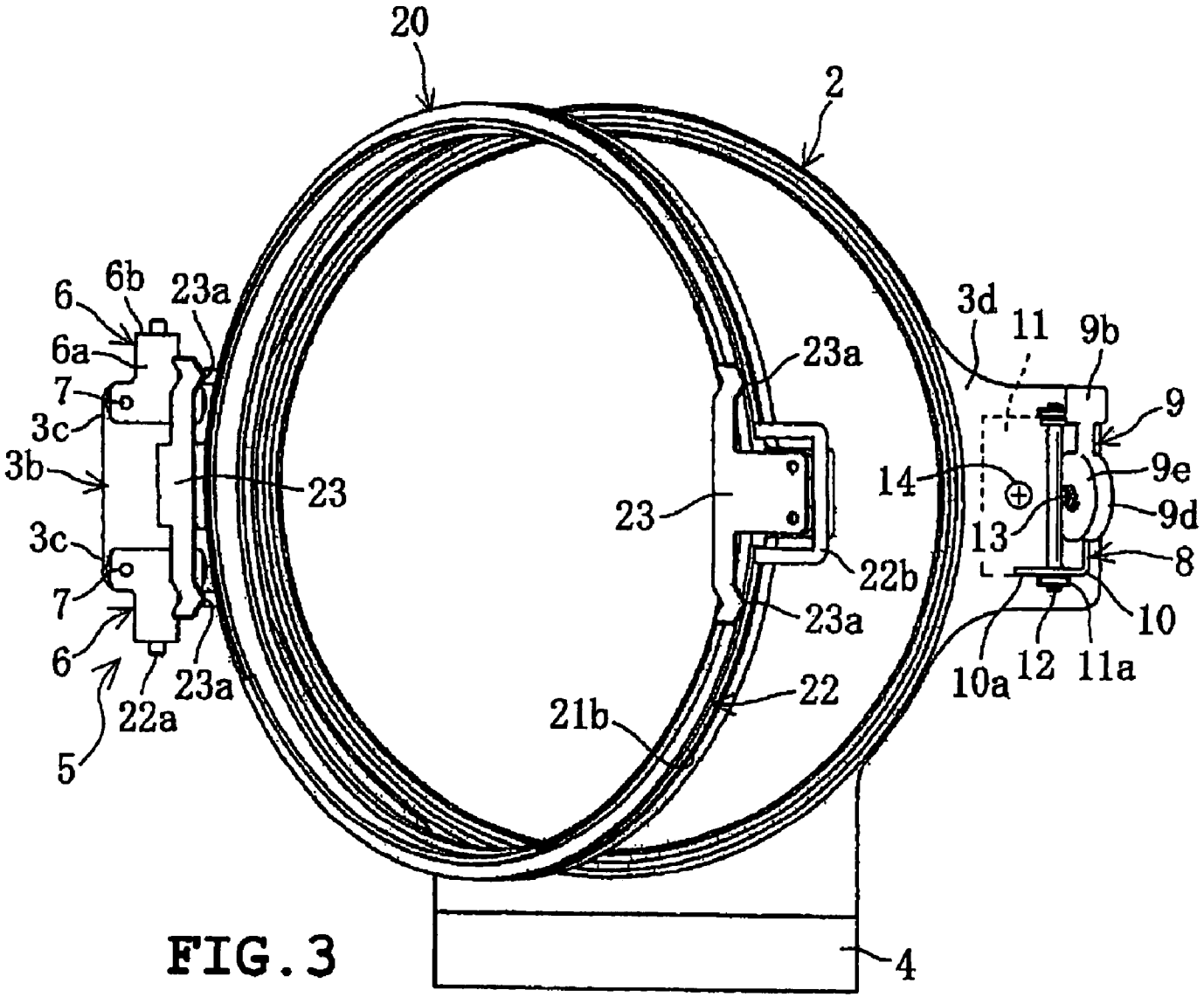
FIG. 3 is a plan view of the upper and lower frames wherein the upper frame is opened.
Figure 4:
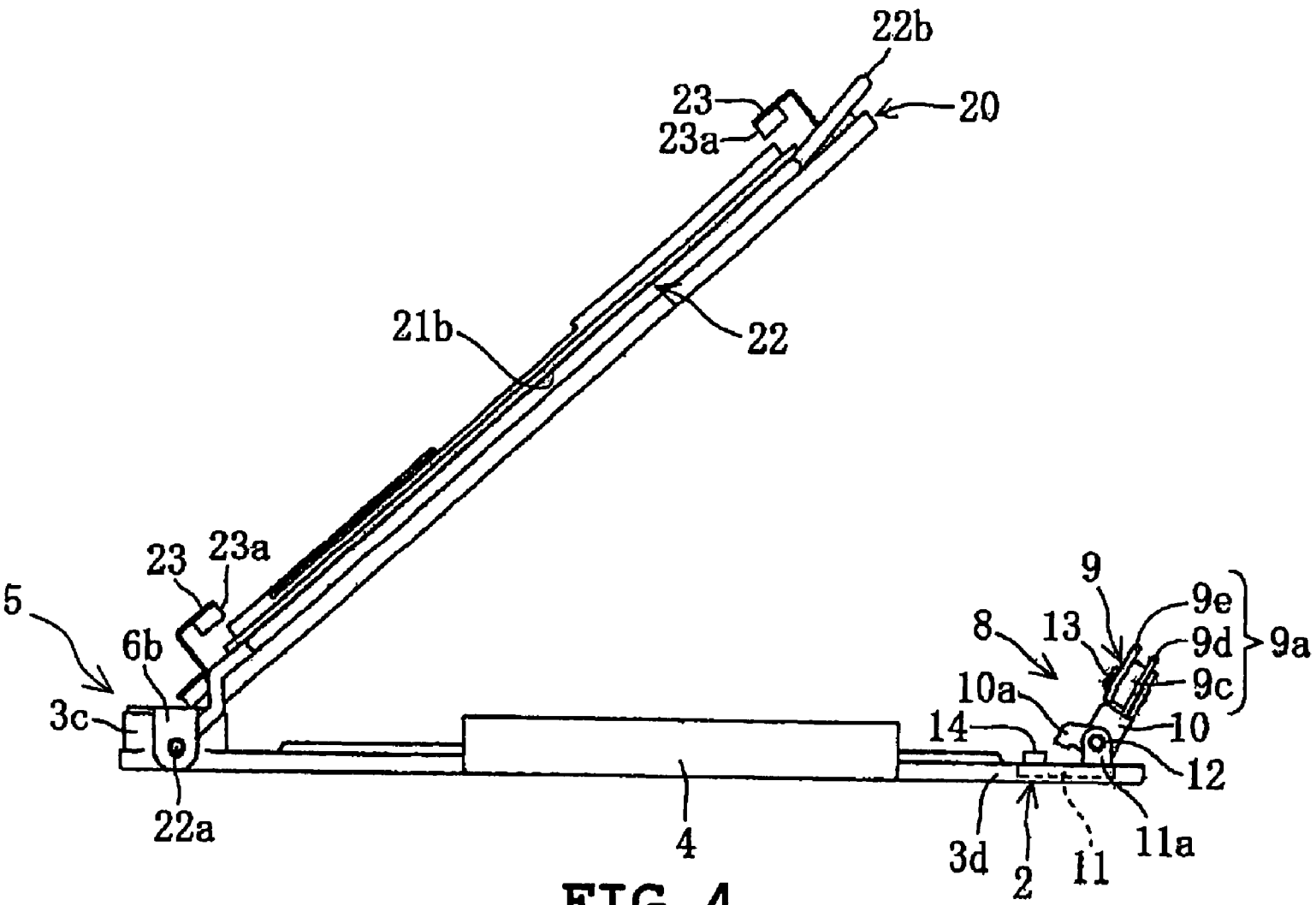
FIG. 4 is a left side view of the upper and lower frames wherein the upper frame is opened.
Figure 5:
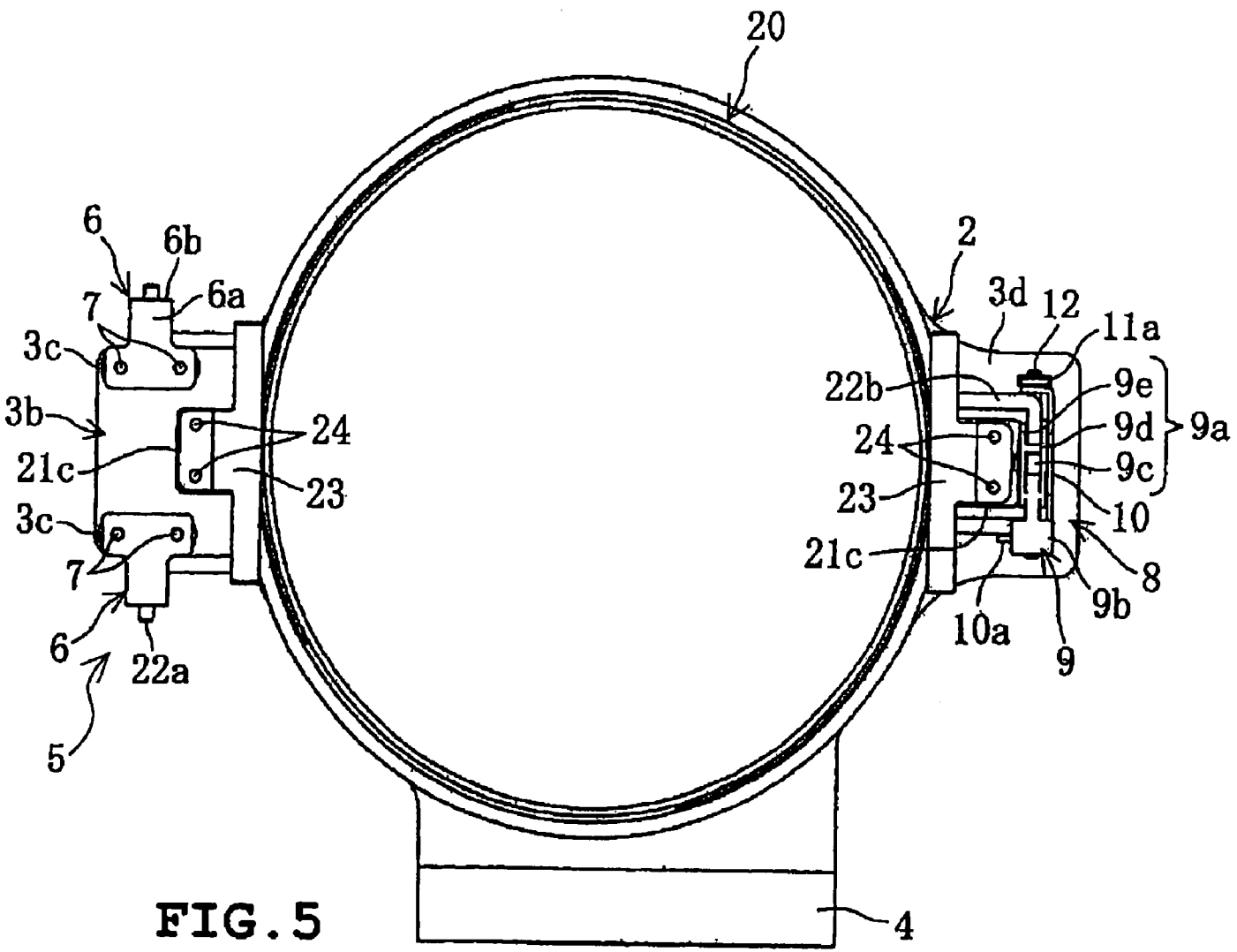
FIG. 5 is a flat view of the upper and lower frames wherein the upper frame is closed.
Figure 6:
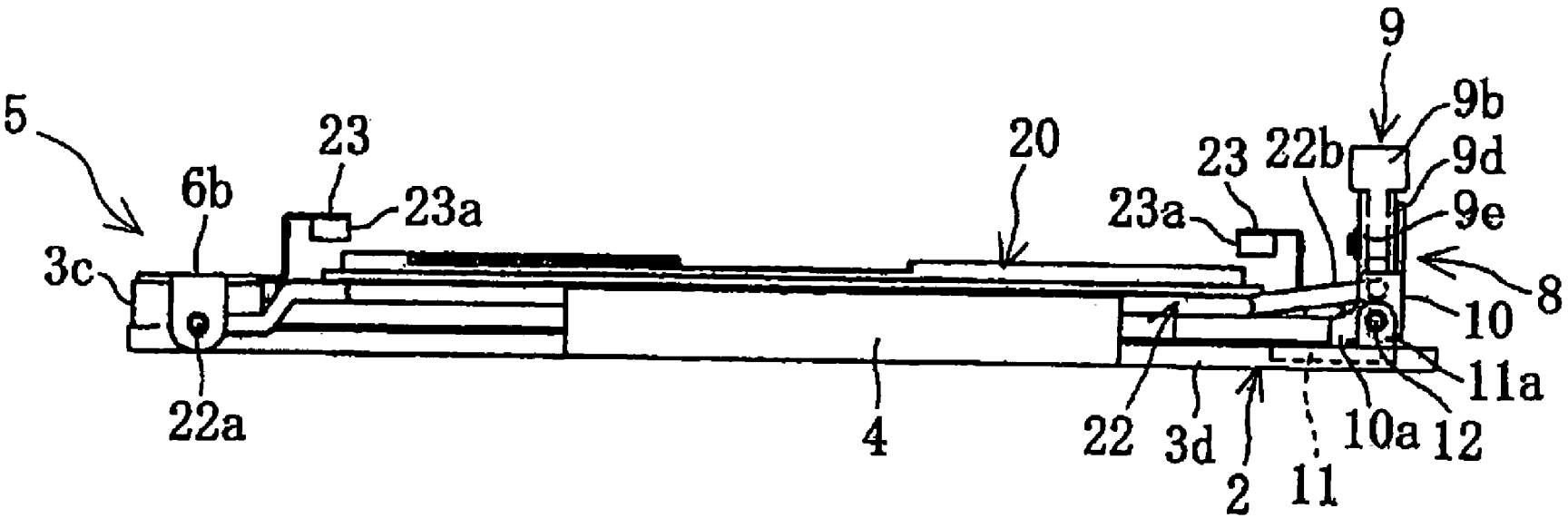
FIG. 6 is a left side view of the upper and lower frames wherein the upper frame is closed.

As shown in FIGS. 3 and 4, when upwardly opening the upper frame 20, the clamp mechanism 8 is switched to the retracted position where the cam member 9 and the support body 10 are inclined in the forward direction. Then, after the upper frame 20 is closed, as shown in FIGS. 5 and 6, the clamp mechanism 8 is switched to the active position in which the cam member 9 and the support body 10 are placed upright. As a result, the lower end of the cam surface of the cam main body 9*c* contacts the upper surface of the fore-end of the clamped portion 22*b*.

A substantially oblong plate-form mounting portion 21*c* is formed in an outwardly protruding manner on the opposing front end and the rear end of the upper frame 20. An engagement regulating member 23 made of a plate spring is fixed on each of the mounting portions 21*c* by 2 screws 24. The engagement regulating members 23 are formed in a substantially T-form and engagement portions 23*a* bent in a v-shape are formed on the lateral ends.

Figure 2:
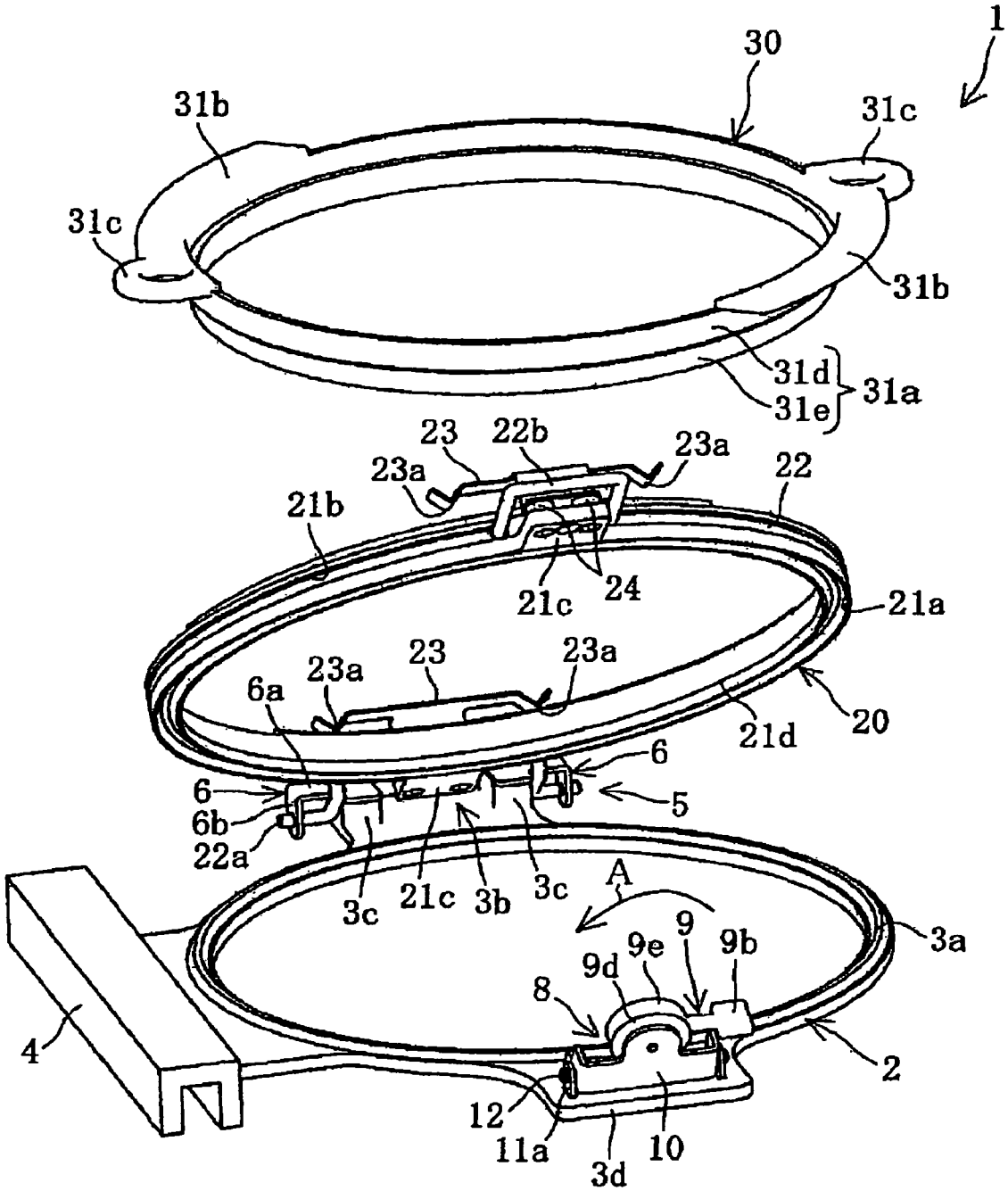
FIG. 2 is a perspective view of the embroidery frame wherein the upper frame is opened and an auxiliary frame is separated.

As shown in FIG. 2, the auxiliary frame 30 is provided with a cylinder body 31*a*, a pair of flanges 31*b*, and a pair of tabs 31*c*. The tabs 31*c* are used for rotating the auxiliary frame 30 in the circumferential direction. The cylinder body 31*a* is provided with a large-diameter portion 31*d* and a small-diameter portion 31*e* which extends below the large-diameter portion 31*d*. When the cylinder body 31*a* is fitted to the inner side of the upper frame 20, the lower end of the large-diameter portion 31*d* approaches the staged portion 21*d* and the small-diameter portion 31*e* is freely fitted to the inner periphery portion below the staged portion 21*d* of the upper frame 20 and the inner periphery portion of the lower frame 2. A pressing portion 31*f* (refer to FIG. 7C) that downwardly presses the workpiece cloth 41 is formed in the lower portion of the small-diameter portion 31*e*.

The flanges 31*b* are engaged with the engagement regulating members 23 of the upper frame 20 and are formed in the opposing positions in the upper end of the auxiliary frame 30. In the present embodiment, the flanges 31*b* and the engagement regulating members 23 constitute a regulating mechanism.

The tabs 31*c* are integrally formed with the flanges 31*b* and are formed in a substantially annular form so as to be easily held with one's fingers. First, the cylinder body 31*a* of the auxiliary frame 30 is fitted into the inner diameter of the upper frame 20 and the lower frame 2. Then, by holding the tabs 31*c* with the tips of one's fingers and rotating the auxiliary frame 30 for a predetermined angle in the circumferential direction with respect to the upper frame 20, the flanges 31*b* and the engagement portions 23*a* of the engagement regulating member 23 can be switched between the engaged and the disengaged state.

When the flanges 31*b* are engaged with the engagement portions 23*a*, the flanges 31*b* are downwardly pressed by the elasticity of the engagement regulating member 23. Therefore, the workpiece cloth 41 is pressed further downward by the pressing portion 31*f* so as to increase the tension of the workpiece cloth 41.

Next, the operation and effect of the above constructed embroidery frame 1 is described. First, the embroidery frame 1 is placed on the table with the upper frame 20 opened. Next, the workpiece cloth 41 to be embroidered is placed on the lower frame 2 in the proper location (refer to FIG. 7A). Then, the upper frame 20 is closed, and the workpiece cloth 41 is clamped between the groove 21*a* of the upper frame 20 and the protrusion 3*a* of the lower frame 2. Next, the clamp mechanism 8 is switched from the retracted position to the active position and the upper surface of the fore-end of the clamped portion 22*b* is contacted to the lower end of the cam surface of the cam main body 9*c*. Then, the operating portion 9*b* of the cam member 9 is rotated counterclockwise when viewed in FIG. 2. Thus, the fore-end of the clamped portion 22*b* is downwardly pressed by the cam surface into a clamped state in which the workpiece cloth 41 is clamped by the upper frame 20 and the lower frame 2 (refer to FIG. 7B).

Next, the cylinder body 31*a* of the auxiliary frame 30 is fitted to the inner periphery of the upper frame 20 and the lower frame 2. Then, by holding the tabs 31*c* with the finger tips and rotating the auxiliary frame 30 in the predetermined angle in the circumferential direction with respect to the upper frame 20 and the flange 31*b* and the engagement portion 23*a* of the engagement regulating member 23 are engaged, the workpiece cloth 41 clamped between the upper frame 20 and the lower frame 2 is further pressed downward by the pressing portion 31*f* of the auxiliary frame 30 (FIG. 7C).

Thus, sufficient tension is generated on the workpiece cloth 41. Moreover, since a mechanism corresponding to a clamp mechanism that presses the auxiliary frame 30 to the workpiece cloth 41 need not be provided on the embroider frame 1, the construction of the embroidery frame 1 is simplified, having fewer parts, thereby reducing the weight and manufacturing cost of the embroidery frame.

Also, in addition to the provision of a pair of flanges 31*b* on the opposing locations of the auxiliary frame 30, a pair of engagement regulating members 23 has been provided on the opposing locations of the upper frame 20. Therefore, the workpiece cloth 41 can be pressed on two opposing locations of the embroidery frame 1, thereby evenly retaining the workpiece cloth 41.

Furthermore, the flange 31*b* and the engagement portion 23*a* of the engagement regulating member 23 can be switched between the engaged state and the disengaged state by a simple operation of rotating the auxiliary frame 30 in the circumferential direction by the predetermined angle with respect to the upper frame 20, with the cylinder body 31*a* of the auxiliary frame 30 fitted in the inner periphery of the of the upper frame 20 and the lower frame 2. Moreover, tabs 31*c* have been provided to the auxiliary frame 30 so that the user can hold the tabs 31*c* by the finger tips and rotate the auxiliary frame 30 in the circumferential direction. Thus, the engagement and the disengagement of the flange 31*b* and the engagement portion 23*a* of the engagement regulating member 23 become easier all the more.

Also, since the engagement regulating member 23 has been made of a plate spring, the engagement regulating member 23 can be realized with a simple construction as well as securely retaining the workpiece cloth 41 by the elasticity generated by the plate spring.

Furthermore, the groove 21*b* has been formed on the outer periphery of the upper frame 20 and the retaining member 22 made of metallic wire material in substantially annular form has been attached on the groove 21*b*. Also, the hinge pins 22*a* are integrally formed to the rear end of the retaining member 22, whereas the clamped portion 22*b* is formed in the front end thereof. Therefore, reduction of parts and manufacturing cost can be attained as compared to providing the hinge pins 22*a* and the clamped portion 22*b* as separate members.

Figure 8:
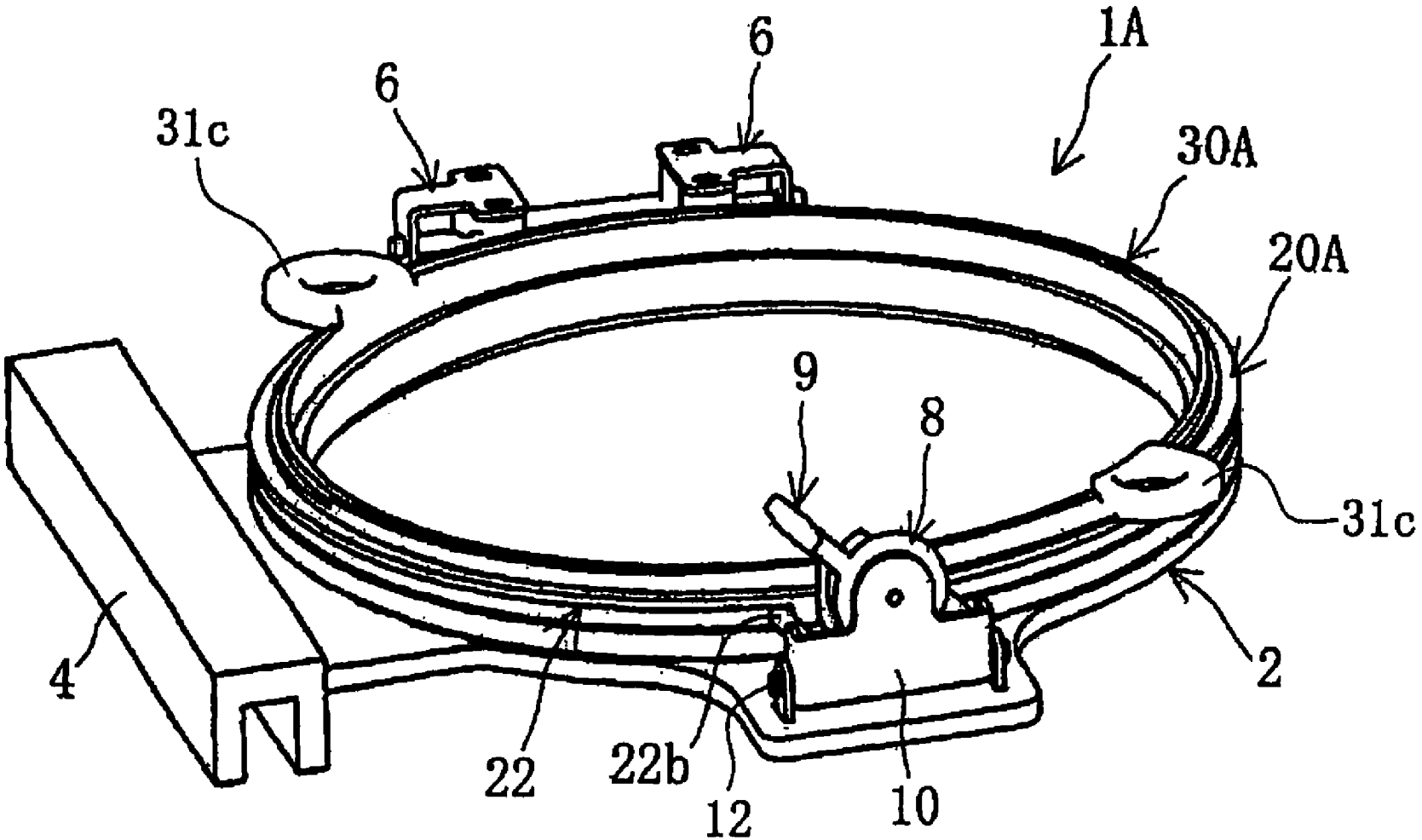
FIG. 8 corresponds to FIG. 1 showing a second illustrative aspect of the disclosure.
Figure 9:
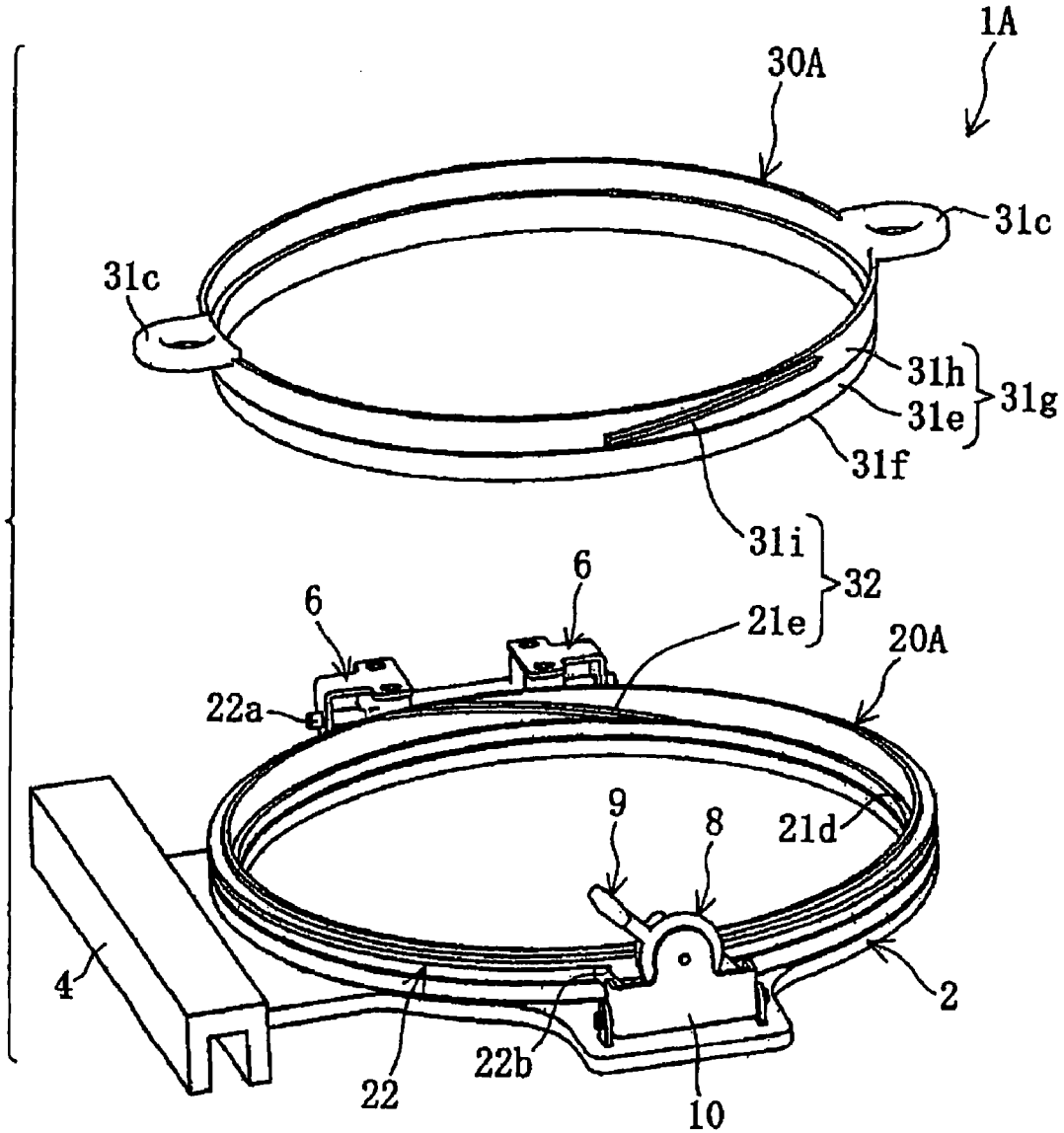
FIG. 9 is a perspective view showing a state wherein the auxiliary frame is separated from the upper and lower frames.

FIGS. 8 and 9 show a second embodiment of the present invention. Components which are common to the first embodiment are identified with the same symbol, and description is given only for portions that differ.

In the second embodiment, in alternative to the flange 31*b* provided in the auxiliary frame 30 and the engagement regulating member 23 provided in the upper frame 20, an engagement mechanism 32 is provided on an auxiliary frame 30A and an upper frame 20A. The engagement mechanism 32 is capable of switching the upper frame 20A and the auxiliary frame 30A between the engaged state and the disengaged state, and the pressure applied to press the workpiece cloth 41 is arranged to be adjustable.

That is, to describe concretely, a spiral groove 21*e* is formed in the inner periphery portion above the staged portion 21*d* of the upper frame 20A. On the outer periphery portion of a large-diameter portion 31*h* of the auxiliary frame 30A, a spiral projection 31*i* that engages with the spiral groove 21*e* is formed. The engagement mechanism 32 is constituted by the spiral projection 31*i* and the spiral groove 21*e*.

By fitting a cylinder body 31*g* of the auxiliary frame 30A to the upper frame 20A and the lower frame 2 and rotating the auxiliary frame 30A by a predetermined angle in the circumferential direction with respect to the upper frame 20A, the spiral projection 31*i* and the spiral groove 21*e* are engaged and disengaged, consequently switching the upper frame 20A and the auxiliary frame 30A between the engaged state and the disengaged state. Also, by adjusting the amount of rotation of the auxiliary frame 30A, the vertical location of the auxiliary frame 30A with respect to the upper frame 20A is changed, consequently adjusting the pressure applied to the workpiece cloth 41 by the pressure portion 31*f*.

Thus, in the present embodiment, the upper frame 20A and the auxiliary frame 30A can be securely engaged by a simple construction composed of the spiral projection 31*i* and the spiral groove 21*e*. Moreover, tension can be applied to the workpiece cloth 41 by further downwardly pressing the workpiece cloth 41 by the pressure portion 31*f* of the embroidery frame 30A. Also, since the vertical position of the auxiliary frame 30A with respect to the upper frame 20A can be adjusted by the amount of rotation of the auxiliary frame 30A, the pressure applied to press the workpiece cloth 41 can be appropriately adjusted depending upon the material or the thickness of the workpiece cloth 41.

The construction, operation, and effect not described above are the same as the first embodiment.

Figure 10:
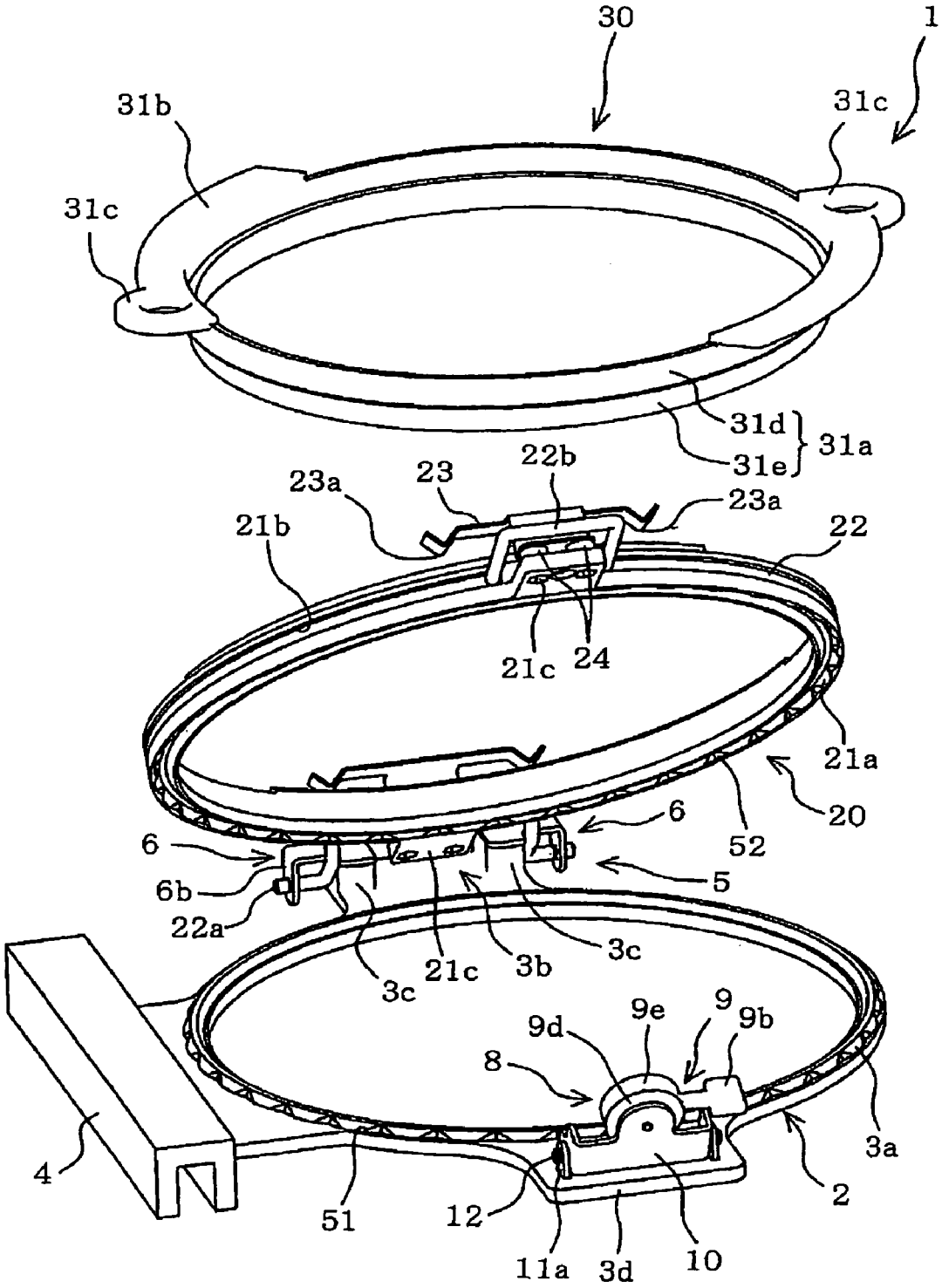
FIG. 10 corresponds to FIG. 2 showing a third illustrative aspect of the disclosure.

FIG. 10 shows the third embodiment of the present embodiment. Components which are common to the first embodiment are identified with the same symbol, and description is given only for portions that differ.

That is, on the entire periphery of a tapered surface which is the outer peripheral surface of the protrusion 3*a* formed on the upper surface of the lower frame 2, a plurality of notched recesses 51 are formed in substantially equal intervals. On the other hand, a plurality of projections 52 corresponding to the notched recesses 51 are formed on the inner surface of the groove 21*a* formed in the lower surface of the upper frame 20, more specifically, on the entire periphery of the tapered surface in the outer peripheral side of the aforementioned inner surface.

When the upper frame 20 is closed, the projection 52 is fitted to the notched recess 51.

According to the above construction, since the area of a cloth clamping surface of the lower frame 2 and the upper frame 20 is increased by providing the notched recess 51 and the projection 52, the frictional force between the lower frame 2 and the upper frame 20 and the work piece cloth 41 clamped therebetween is increased. Therefore, the retainability of the lower frame 2 and the upper frame 20 is improved.

Also, in the present embodiment, the length in the circumferential direction of the outer peripheral portion of the protrusion 3*a* and the groove 21*a* are arranged to be longer than the length in the circumferential direction of the inner peripheral portion owning to the notched recess 51 and the projection 52. Hence, transformation of the workpiece cloth 41 can be restrained by being clamped between the protrusion 3*a* in the lower frame 2 and the groove 21*a* in the upper frame 20, an the workpiece cloth 41 can be made less prone to creasing.

Furthermore, because of the notched recess 51 and the projection 52, the lower and upper frames 2 and 20 can be precisely fitted with each other without any misplacement.

The present invention is not limited to the above embodiments but can be transformed as follows.

The engagement regulating member 23 may be constructed by an elastic member besides the plate spring. Also, the engagement regulating member can be constructed by an alternative member such as a non-elastic metallic plate as long as the upward movement of the auxiliary frame 30 can be regulated by the engagement with the flange 31*b* when the cylinder body 31*a* is fitted to the inner side of the upper frame 20 and the lower frame 2.

The number and the location to which the engagement regulating member 23 and the flange 31*b* are provided can be changed applicably.

The spiral groove may alternatively be formed on the outer periphery of the auxiliary frame 30A and the spiral projection may be formed on the inner periphery of the upper frame 20A to serve as the engagement mechanism 32. Also, the spiral projection can be formed respectively on the auxiliary frame 30A and the upper frame 20A so as to engage the spiral projections to each other.

The notched recess 51 and the projection 52*a* may be provided respectively on the protrusion 3*a* of the lower frame 2 and the groove 21*a* of the upper frame 20A according to the second embodiment.

The notched recess and the projection may be provided on a part of the protrusion and the groove instead of the entire periphery of the protrusion and the groove.

The number of flanges provided on the auxiliary frame and the number of engagement regulating members provided on the upper frame may be 3 or more.

The foregoing description and drawings are merely illustrative of the principles of the present invention and are not to be construed in a limited sense. Various changes and modifications will become apparent to those of ordinary skill in the art. All such changes and modifications are seen to fall within the scope of the invention as defined by the appended claims.

I claim:

1. An embroidery frame provided with an upper frame, a lower frame that clamps a workpiece cloth with the upper frame, a hinge openably linking the upper and lower frames, and a clamping unit that presses the upper frame to the lower frame, the embroidery frame comprising;

an auxiliary frame which, on a part of an upper end thereof, is provided with a flange and which is fitted in an inner side of the upper frame so as to downwardly press the workpiece cloth clamped between the upper and lower frames; and an engagement regulating member which is provided on the upper frame and which is engaged to the flange so as to regulate the upward movement of the auxiliary frame.

2. The embroidery frame according to claim 1, further comprising a plurality of flanges and engagement regulating members.

3. The embroidery frame according to claim 1, wherein engagement and disengagement of the flange and the engagement regulating members are switchable by rotating the auxiliary frame fitted in the upper frame by a predetermined angle in a circumferential direction with respect to the upper frame.

4. The embroidery frame according to claim 3, wherein the auxiliary frame has tabs for rotating the auxiliary frame in the circumferential direction.

5. The embroidery frame according to claim 1, wherein the engagement regulating member is constructed by an elastic member that presses the flange from above when the auxiliary frame is engaged to the upper frame.

6. The embroidery frame according to claim 1, wherein the upper frame has an outer peripheral portion formed with an annular groove, and a retaining member which is made of metallic material in a substantially annular form is attached on the annular groove, and wherein the hinge which is rotatably supported by the lower frame is formed on a base end of the retaining member and a clamped portion which is clamped by a clamp unit is formed on a fore-end of the retaining member.

7. An embroidery frame provided with an upper frame, a lower frame that clamps a workpiece cloth with the upper frame, a hinge openably linking the upper and lower frames, and a clamping unit that presses the upper frame to the lower frame, the embroidery frame comprising;

an auxiliary frame which is fitted in an inner side of the upper frame and which downwardly presses the workpiece cloth clamped between the upper and lower frames; and an engagement mechanism in which engagement and disengagement of the upper frame and the auxiliary frame is switchable by rotating the auxiliary frame fitted in the upper frame by a predetermined angle in the circumferential direction with respect to the upper frame; and in which the auxiliary frame is capable of adjusting the pressure applied to press the workpiece cloth.

8. The embroidery frame according to claim 7, wherein the engagement mechanism is provided with a spiral projection formed on an outer peripheral portion of the auxiliary frame and a spiral groove which is formed in the inner periphery portion of the upper frame and which engages with the spiral projection.

9. The embroidery frame according to claim 7, wherein the auxiliary frame has a tab for rotating the auxiliary frame in the circumferential direction.

10. The embroidery frame according to claim 7, wherein the upper frame has an outer peripheral portion formed with an annular groove, and a retaining member which is made of metallic material in a substantially annular form is attached on the annular groove, and wherein the hinge which is rotatably supported by the lower frame is formed on a base end of the retaining member and a clamped portion which is clamped by a clamp unit is formed on a fore-end of the retaining member.

11. An embroidery frame provided with an upper frame, a lower frame that clamps a workpiece cloth with the upper frame, a hinge openably linking the upper and lower frames, and the clamping unit that presses the upper frame to the lower frame, the embroidery frame comprising;

an auxiliary frame which is fitted in an inner side of the upper frame and which downwardly presses the workpiece cloth clamped between the upper and lower frames;

a regulating mechanism that regulates the upward movement of the auxiliary frame with respect to the upper frame, the auxiliary frame being fitted in the upper frame;

a projection which is formed on either one of an upper surface of the lower frame or a lower surface of the upper frame and which has, on an outer peripheral portion thereof, a plurality of notched recesses; and a groove which is formed on the other of the upper surface of the lower frame or the lower surface of the upper frame and which has, on an outer peripheral portion thereof, a projection that is fitted with the groove when the upper and lower frames are closed.

* * * * *